United States Patent [19]

Jahn et al.

[11] Patent Number: 5,035,178

[45] Date of Patent: Jul. 30, 1991

[54] WASHING DEVICE FOR CLEANING A CYLINDER OF A PRINTING MACHINE

[75] Inventors: Hans-Georg Jahn, Wiesenbach; Hermann Beisel, Walldorf; Karl-Heinz Seefried, Zuzenhausen, all of Fed. Rep. of Germany

[73] Assignee: Heidelberger Druckmaschinen AG, Heidelberg, Fed. Rep. of Germany

[21] Appl. No.: 499,028

[22] Filed: Mar. 26, 1990

[30] Foreign Application Priority Data

Mar. 24, 1989 [DE] Fed. Rep. of Germany ..... 3909819

[51] Int. Cl.[5] ..... B41F 35/00; B41L 41/00

[52] U.S. Cl. ..... 101/425; 15/256.51; 15/88.3; 15/37

[58] Field of Search ..... 101/425, 423, 424; 15/256.51, 256.52, 88.3, 37, 38

[56] References Cited

U.S. PATENT DOCUMENTS

| | | | |
|---|---|---|---|
| 1,082,409 | 12/1913 | Cormack | 101/424 |
| 2,705,455 | 4/1955 | Büttner | 101/425 |
| 2,952,859 | 9/1960 | Alcamo | 15/88.3 |
| 3,809,105 | 5/1974 | Horner | 15/88.3 X |
| 4,015,307 | 4/1977 | Kossak | 15/256.52 |
| 4,747,348 | 5/1988 | Jeschke | 101/425 |

FOREIGN PATENT DOCUMENTS

| | | | |
|---|---|---|---|
| 314053 | 8/1919 | Fed. Rep. of Germany | 15/256.52 |
| 315570 | 11/1919 | Fed. Rep. of Germany | 15/256.52 |

*Primary Examiner*—Clifford D. Crowder
*Assistant Examiner*—Eric P. Raciti
*Attorney, Agent, or Firm*—Herbert L. Lerner; Laurence A. Greenberg

[57] ABSTRACT

Washing device for cleaning a cylinder of a printing machine includes a brush roller formed with bristles and rotatably driven about an axis, the brush roller cooperatively engaging the cylinder, a device for feeding washing fluid to the bristles for self-cleaning the bristles, and a deflection element disposed in a rotational region of the bristles, fixed in position relative to the brush roller and extending along the length of the brush roller, the bristles yieldingly brushing against the deflection element as the brush roller is rotated so as to be bent temporarily and subsequently returned to a straight extended position thereof, the deflection element being formed as a distributor pipe connected to the feeding devices and having outlet openings formed therein for directing the washing fluid radially towards the axis of the brush roller.

11 Claims, 2 Drawing Sheets

WASHING DEVICE FOR CLEANING A CYLINDER OF A PRINTING MACHINE

Figure 1:
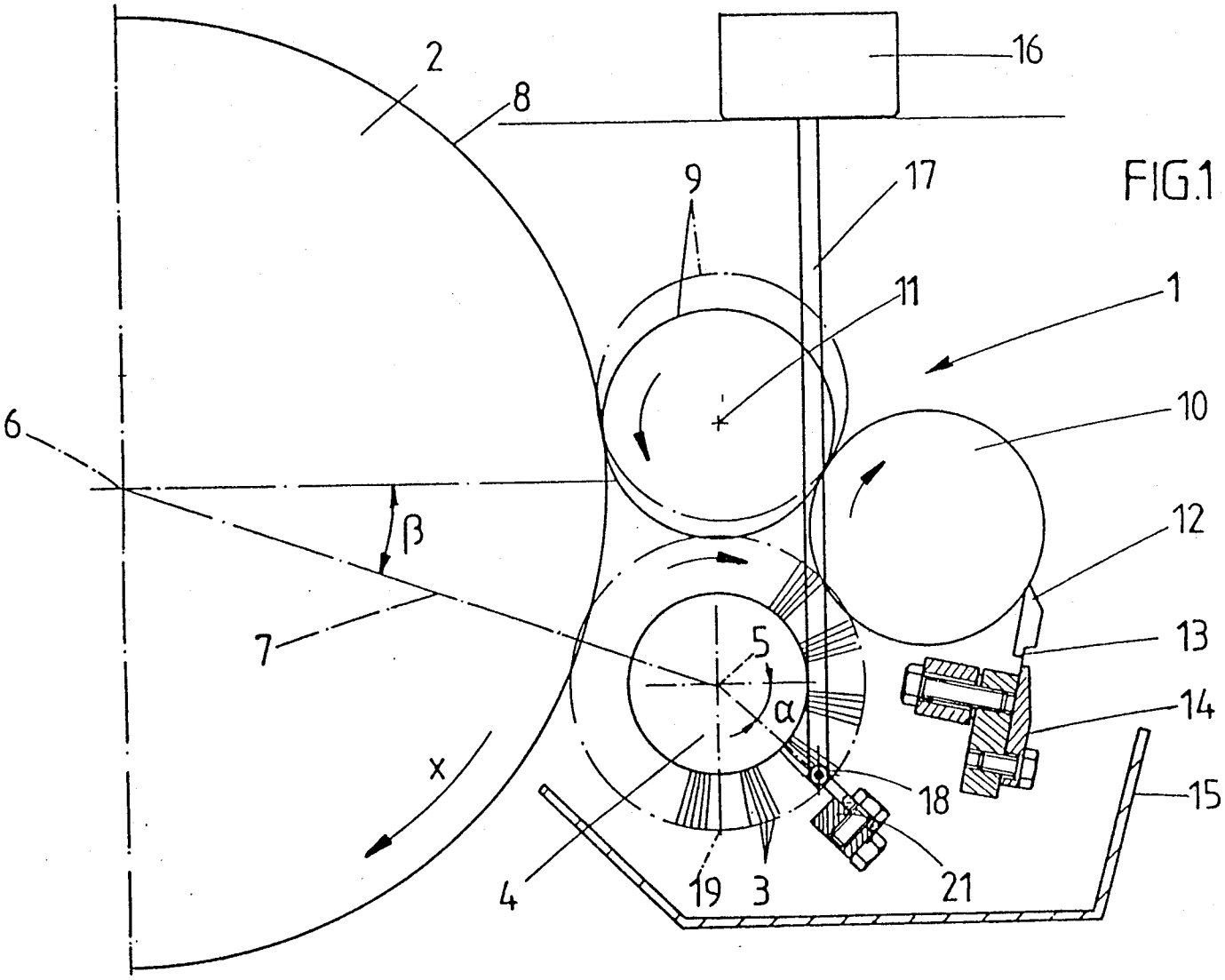

The invention relates to a washing device for cleaning a cylinder of a printing machine.

Washing devices of this general type are used in order to obtain good print quality. From German Published, Prosecuted Application (DE-AS) 1 124 974, a washing device for a rubber blanket cylinder of an offset printing machine has become known heretofore which has two brush rollers disposed closely to one another and in immediate contact with the rubber blanket cylinder, washing fluid being fed through hollow shafts of the rollers and discharging through bores distributed about the circumference of the shafts. On the cylindrical surfaces of the brush rollers, which are located opposite one another, a plurality of wires are provided, which form a deflection element. The wires forming the deflection element are supposed to throw towards the respective adjacent brush roller particles of dirt and washing fluid which have been, thrown off at the respective contact point with the rubber blanket cylinder. This means that corresponding particles of dirt travel from one brush roller to the other, and must, therefore, still have to be removed.

Due to the feeding of the washing fluid through the shafts of the brush rollers, not only is there a considerable demand for washing fluid, but also an increased constructional expenditure, particularly with respect to appropriate sealing, and so forth.

It is accordingly an object of the invention to provide a washing device of the foregoing general type which is of relatively simple construction, and wherein there is a heightened washing effect with a simultaneously low consumption of washing fluid.

With the foregoing and other objects in view, there is provided, in accordance with the invention, a washing device for cleaning a cylinder of a printing machine, comprising a brush roller formed with bristles and rotatably driven about an axis, the brush roller cooperatively engaging the cylinder, means for feeding washing fluid to the bristles for self-cleaning the bristles, and a deflection element disposed in a rotational region of the bristles, fixed in position relative to the brush roller and extending along the length of the brush roller, the bristles yieldingly brushing against the deflection element as the brush roller is rotated so as to be bent temporarily and subsequently returned to a straight extended position thereof, the deflection element being formed as a distributor pipe connected to the feeding means and having outlet openings formed therein for directing the washing fluid radially towards the axis of the brush roller.

In accordance with another feature of the invention, the distributor pipe is disposed upstream of a lowest point of the rotational region of the bristles, as viewed in rotational direction of the brush roller.

In accordance with a further feature of the invention, the distributor pipe is located at a rotary angle of about 45 degrees upstream of the lowest point of the rotational region.

In accordance with an added feature of the invention, the washing-fluid feeding means comprise a feed pipe extending from a supply tank subjected to atmospheric pressure and located above the distributor pipe, the feed pipe being connected to the distributor pipe.

In accordance with an additional feature of the invention, there are provided, means for forming a jet of washing fluid at the outlet openings.

In accordance with yet another feature of the invention, the cylinder being cleaned has an axis, and the axis of the brush roller is located below the axis of the cylinder.

In accordance with yet a further feature of the invention, a rubber roller rollingly engaging the cylinder being cleaned is mounted upstream of the brush roller, as viewed in direction of rotation of the cylinder.

In accordance with yet an added feature of the invention, there is provided, a doctor roller rollingly engaging the rubber roller.

In accordance with yet an additional feature of the invention, there is provided, a doctor blade cooperatively engaged by the doctor roller for mechanically stripping off impurities.

In accordance with still another feature of the invention, the rubber roller is disposed above the brush roller and is in contact with the cylinder being cleaned, the brush roller and the doctor roller.

In accordance with a concomitant feature of the invention, the doctor roller is in contact with the brush roller.

As a result of such a configuration, a washing device of the foregoing general type is created, which is distinguished in particular by an increased consumption value. The deflection element is constructed as a distributor pipe located in the rotational region of the brush-roller bristles, so that this distributor pipe fulfills a double function: on the one hand, it serves to deflect the bristles, whereby a mechanical cleaning effect is achieved due to the travel of the bristles along the deflection element, and a subsequent springy resetting movement of the bristles. On the other hand, the distributor pipe also serves to feed the washing fluid through the outlet openings directed therein radially to the brush axis. Because the distributor pipe does not revolve with the brush roller, as is the case in the state of the art, the constructional measures for sealing purposes can be kept to a minimum.

Advantageously, the discharge of the washing fluid occurs directly at the very location where the mechanical cleaning is carried out by the bristles. After the washing fluid has left the outlet openings, it flows initially in the direction of the brush axis, thereby moistening the bristles to which the ink and paper residues, which have been removed from the rubber blanket cylinder, adhere. The rotating brush roller then, due to centrifugal force, causes a reversal in the direction of flow of the washing fluid which has reached the bristles. Simultaneously, the bristles must, by deflecting, must pass the distributor pipe located within the range or region of rotation thereof. A consequence thereof is that the bristles bend due to their internal elasticity, and execute an overlapping stripping movement along the distributor pipe to the effect that any impurities located on the bristles are thereby moved in the direction towards the end of the bristles. The instant the bristle tips have passed the distributor pipe, an acceleration occurs due to the return of the bristles to the straight or extended positions thereof, with the result that impurities remaining on the bristles are thrown off, combined with an effective cleaning of the bristles of the brush roller. This back-and-forth flow of the washing fluid on the bristles of the brush roller leads to a soaking effect together with good cleaning results and with a minimal requirement for washing fluid. The good cleaning of the brush roller permits a more thorough cleaning of the rubber blanket cylinder. Furthermore, an increase in production is possible due to briefer machine stoppage periods which result from briefer washing periods. Because the moistened bristles, while the impurities are being soaked out, are constantly moving past the distributor pipe and produce a rinsing effect, the distributor pipe is largely freed from accumulations of impurities. In addition, the distributor pipe is so disposed that the particles of impurities which are hurled off are not deflected in the direction of the rubber blanket cylinder, but rather, according to the intended purpose, into a collecting pan extending over the area beneath the washing device. In particular, arranging of the distributor pipe about 45 degrees in front or upstream of the lowest point of the brush, i.e., the tip of the lowermost downwardly extending bristle, proves to be a favorable solution. Supplying the distributor pipe through a supply tank disposed above it results in an altogether technically simple construction. Corresponding feed pumps which must be separately driven can accordingly be dispensed with. The supply tank is so disposed, and the outlet openings are of such dimensions, that a jet of washing fluid is formed at the latter which is deflected in the direction of the axis of the brush roller. Accordingly, the cleaning effect extends over a very large region of the bristles. Also, the arrangement of the brush roller in relation to the rubber blanket cylinder is such that the axis of the brush roller lies beneath the axis of the rubber blanket cylinder. The preceding measure creates a favorable precondition to preassign to the brush roller a rubber roller rolling against the rubber blanket cylinder, upstream thereof as viewed in the direction of rotation of the rubber blanket cylinder, in order to accelerate the washing procedure for the rubber blanket cylinder. Furthermore, a doctor roller, acting as an accelerator, also rolls on the rubber roller. The doctor roller cooperates with a doctor blade for the purpose of mechanically stripping off impurities, the ink and paper particles reaching the doctor roller from the rubber roller being largely removed. The cleaning effect is reinforced by the measure of bringing the rubber roller disposed above the brush roller into contact with the rubber blanket cylinder, the brush roller and the doctor roller. A closed roller configuration, with optimal cleaning effect, is achieved by the doctor roller being also in contact with the brush roller. A mutual influence, which is aimed at accelerated removal of the existing impurities and at guiding them into the collecting pan, therefore occurs.

Other features which are considered as characteristic for the invention are set forth in the appended claims.

Although the invention is illustrated and described herein as embodied in a washing device for cleaning a cylinder of a printing machine, it is nevertheless not intended to be limited to the details shown, since various modifications and structural changes may be made therein without departing from the spirit of the invention and within the scope and range of equivalents of the claims.

Figure 2:
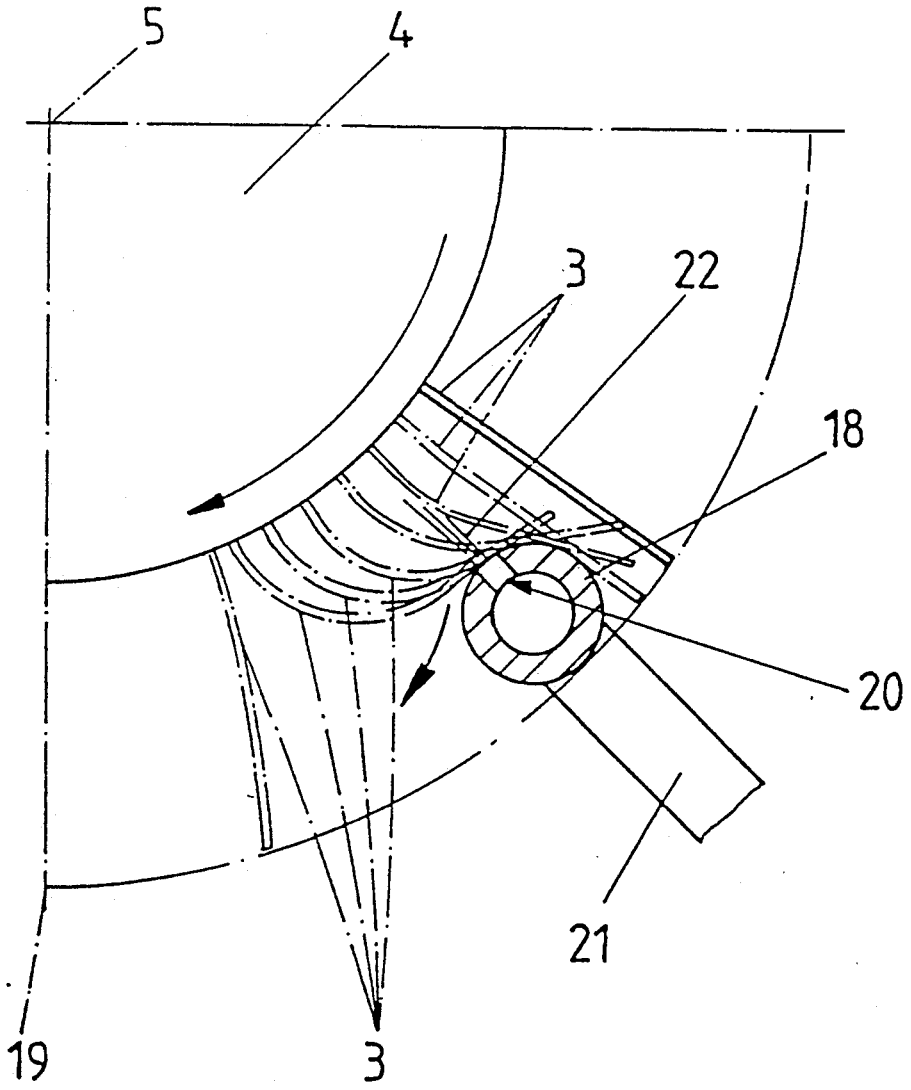

The construction and method of operation of the invention, however, together with additional objects and advantages thereof will be best understood from the following description of specific embodiments when read in connection with the accompanying drawings, in which:

FIG. 1 is a diagrammatic front elevational view of a washing device for cleaning a printing-press cylinder, shown in operating position thereof; and FIG. 2 is an enlarged fragmentary view of FIG. 1 showing a section of a brush roller in vicinity of a distributor pipe, and illustrating a bristle moving past the distributor pipe in successive rotary-angle positions of the brush roller.

Referring now to the drawing and, first, particularly to FIG. 1 thereof, there is shown a washing device identified as a whole by reference numeral 1, which is assigned to a rubber blanket cylinder 2, shown only in part, and drivable in the direction of an arrow x. An essential component of the washing device 1 is a rotatably driven brush roller 4 formed with bristles 3. The brush roller 4 has an axis 5 which is disposed below an axis 6 of the rubber blanket cylinder 2. A connecting line 7 passing through both axes 5 and 6 forms an angle beta of about 20 degrees with respect to the horizontal.

In the direction of rotation of the rubber blanket cylinder 2, as indicated by an arrow x, a rubber roller 9 is mounted ahead of the brush roller 4 and rolls on the rubber blanket cylinder 2 and the cylinder surface area 8 thereof, respectively. The phantom line in FIG. 1 indicates that the rubber roller 9 is adjustable in a vertical direction. The rubber roller 9 represented by a solid line in FIG. 1 contacts the brush roller 4 in addition to the rubber blanket cylinder 2. Furthermore, a doctor roller 10 rolls on the rubber roller 9. The doctor roller 10, in turn, is in contact with the brush roller 4. The diameters of the doctor roller 10 and the rubber roller 9 are smaller than the diameter of the brush roller 4 formed by the tips of the bristle. It can also be seen from FIG. 1, that the axis of the rubber roller 11 is disposed above the axis 6 of the rubber blanket cylinder 2.

The doctor roller 10 cooperates with a doctor blade 12 to wipe or strip off impurities. The latter reach the surface area of the doctor roller 10 via the rubber roller 9 and the brush roller 4, and are then stripped off by the doctor blade 12. The doctor blade 12 extends over the entire length of the doctor roller 10, which length corresponds to that of the other rollers 4 and 9. The doctor blade 12 is held by a spring element 13, which is seated on a conventional adjusting device 14.

A collecting pan 15 for washing fluid is located under the entire washing device 1. The washing fluid is fed to a deflection element formed as a distributor pipe 18 from a supply tank 16 or the like, under atmospheric pressure, and via a feed pipe 17. As shown more clearly in FIG. 2, the distributor pipe 18 is disposed upstream of the lowest point 19 of the rotational region brushed by the bristles, as viewed in the direction of rotation, i.e. the tip of the most downwardly extending bristle, and, in fact, at an angle alpha of about 45 degrees upstream from that lowest point 19. Furthermore, the distributor pipe 18 is provided with outlet openings 20 extending over the length thereof and directed radially towards the brush axis 5. The non-illustrated spacing between the outlet openings 20 is about 10 mm, so that a uniform moistening of the brush roller is effected through the outlet openings 20. The distributor pipe 18 is fixed in position by a retainer or holder 21, so that the distributor pipe 18 remains in its intended position while a cleaning operation takes place.

Due to the positioning of the supply tank 16 at an appropriate height above the distributor pipe 18, and due to the adjusted dimensioning of the outlet openings 20, a jet of washing fluid 22 FIG. 2 is formed which is sprayed in a direction towards the axis 5 of the brush roller 4.

During the cleaning of the rubber blanket cylinder 2, a loosening of the impurities, such as ink and paper residues, located on the cylindrical surface 8 of the rubber blanket cylinder 2, takes place. If necessary or desirable, the rubber roller 9 can be moistened independently of the brush roller 4. A part of the impurities adhering to the cylindrical surface of the rubber roller 9 reaches the doctor roller 10 and is removed therefrom by the doctor blade 12. Likewise, the bristles 3 remove corresponding impurities from the cylindrical surface of the rubber roller 9 and carry a part of them to the doctor roller 10. The brush roller 4 driven in a direction opposite to the direction of rotation x of the rubber blanket cylinder 2 performs a traversing movement of 4 to 5 mm, i.e., along the axis 5, into and out of the plane of the drawing of FIG. 1. The impurities located on the bristles 3 are effectively removed by the distributor pipe 18, which forms a spray doctor blade, so that the rubber blanket cylinder 2 is also subjected thereby to an accelerated cleaning. The fluid jet 22 coming from the outlet openings 20 of the distributor pipe 18 reaches as far as the roots of the bristles 3 and experiences, as a consequence of centrifugal force, an outwardly directed deflection therefrom, any impurities adhering to the bristles 3 being entrained therewith. In the fragmentary view of FIG. 2, a bristle 3 is shown in its various positions representing the movements which the bristle 3 performs when passing the distributor pipe 18. The bristle 3 represented by solid lines in FIG. 2 illustrates the position adopted by the bristle 3 as it moves towards the circumference of the distributor pipe 18. From the following rotational-angle positions of the bristle 3, represented in phantom, it is apparent that the bristle 3 experiences a bend or curvature opposed to the inner elasticity or resilience thereof. As a consequence of the rotational movement of the brush roller 4, the bristle end brushes past the distributor pipe 18, impurities being likewise guided to the end of the bristle. This is also assisted by the washing fluid running along the bristle 3. When the brush roller 4 has turned far enough, the bristle tip no longer finds adequate support on the distributor pipe 18, so that the bristle 3 is able to return to its straight extended position while simultaneously flinging the impurities in a direction towards the bottom of the collecting pan 15. Adherence of impurities to the distributor pipe 18 is also largely avoided, because the bristles continuously brush past it. Because the distributor pipe 18, furthermore, is constantly rinsed by the washing fluid travelling in a radially outward direction, viewed as a whole, a soaking or flooding effect, directed from the inside towards the outside, is produced.

After the cleaning of the rubber blanket cylinder 2 and the cylindrical surface 8 thereof, respectively, has taken place, the action of the entire washing device 1 is terminated.

The foregoing is a description corresponding in substance to German Application P 39 09 819.2, dated Mar. 24, 1989, the International priority of which is being claimed for the instant application, and which is hereby made part of this application. Any material discrepancies between the foregoing specification and the aforementioned corresponding German application are to be resolved in favor of the latter.

We claim:

1. Washing device for cleaning a cylinder of a printing machine, comprising a brush roller formed with bristles and rotatably driven about an axis, said brush roller cooperatively engaging the cylinder, and a deflection element disposed adjacent said bristles, fixed in position relative to said brush roller and extending along the length of said brush roller, said bristles yieldingly brushing against said deflection element as said brush roller is rotated so as to be bent temporarily and subsequently returned to a straight extended position thereof, said deflection element being formed as a distributor pipe connected to a source of washing fluid and having outlet openings formed therein, said outlet openings being oriented to direct the washing fluid radially towards said axis of said brush roller.

2. Washing device according to claim 1, wherein said distributor pipe is disposed upstream of a lowest point of said bristles, as viewed in rotational direction of said brush roller.

3. Washing device according to claim 2, wherein said distributor pipe is located at an angle of about 45 degrees upstream of said lowest point of said bristles, as viewed in said rotational direction of said brush roller.

4. Washing device according to claim 1, including a supply tank subjected to atmospheric pressure and located above said distributor pipe, a feed pipe extending from said supply tank, said feed pipe being connected to said distributor pipe.

5. Washing device according to claim 1, including means for forming a jet of washing fluid at said outlet openings.

6. Washing device according to claim 1, wherein the cylinder being cleaned has an axis, and said axis of said brush roller is located below the axis of the cylinder.

7. Washing device according to claim 1, wherein a rubber roller rollingly engaging the cylinder being cleaned is mounted upstream of said brush roller, as viewed in direction of rotation of the cylinder.

8. Washing device according to claim 7, wherein a doctor roller is disposed adjacent to and rollingly engages said rubber roller.

9. Washing device according to claim 8, wherein a doctor blade is cooperatively engaged by said doctor roller for mechanically stripping off impurities.

10. Washing device according to claim 8, wherein said rubber roller is disposed above said brush roller and is in contact with the cylinder being cleaned, said brush roller and said doctor roller.

11. Washing device for cleaning a cylinder of a printing machine, comprising a brush roller formed with bristles and rotatably driven about an axis, said brush roller cooperatively engaging the cylinder, means for feeding washing fluid to said bristles for self-cleaning said bristles, a deflection element disposed adjacent said bristles, fixed in position relative to said brush roller and extending along the length of said brush roller, said bristles yieldingly brushing against said deflection element as said brush roller is rotated so as to be bent temporarily and subsequently returned to a straight extended position thereof, said deflection element being formed as a distributor pipe connected to said feeding means and having outlet openings formed therein for directing the washing fluid radially towards said axis of said brush roller, a rubber roller rollingly engaging the cylinder being cleaned and being mounted upstream of said brush roller, as viewed in direction of rotation of the cylinder, a doctor roller disposed adjacent to and rollingly engaging said rubber roller, said doctor roller being in contact with said brush roller.

* * * * *